United States Patent [19]

Niemi

[11] Patent Number: 4,720,320

[45] Date of Patent: Jan. 19, 1988

[54] APPARATUS FOR SPLICING A TRAILING END OF A WEB FROM A DEPLETED COIL TO THE LEADING END OF A FRESH COIL

[75] Inventor: Paul M. Niemi, Winnebago County, Wis.

[73] Assignee: Kimberly-Clark Corporation, Neenah, Wis.

[21] Appl. No.: 835,691

[22] Filed: Mar. 3, 1986

[51] Int. Cl.[4] ..... B65H 19/20; B65H 69/06

[52] U.S. Cl. ..... 156/504; 156/159; 156/505; 242/56 R; 242/58.1; 242/58.5

[58] Field of Search ..... 156/157, 159, 504, 505; 242/56 R, 58.1, 58.5

[56] References Cited

U.S. PATENT DOCUMENTS

| | | | |
|---|---|---|---|
| 2,768,690 | 10/1956 | Roberts et al. | 242/56 R |
| 3,089,661 | 5/1963 | Phillips et al. | 242/58.4 |
| 3,489,628 | 1/1970 | Catzen | 156/159 |
| 3,567,552 | 3/1971 | Heuff | 242/56 R |
| 3,717,057 | 2/1973 | Takimoto | 156/505 |
| 4,067,760 | 1/1978 | Nelson | 156/505 |
| 4,363,695 | 12/1982 | Marass | 156/504 |
| 4,481,053 | 11/1984 | Tokuno et al. | 156/157 |
| 4,492,609 | 1/1985 | Blom | 156/507 |

*Primary Examiner*—Michael Wityshyn

*Attorney, Agent, or Firm*—Douglas L. Miller; Donald L. Traut; Jeremiah J. Duggan

[57] ABSTRACT

An improved process and apparatus for splicing a new web to a running web including cutting the old web between two rollers, the first roller having a cutting means, a rotating means, an actuating means and the second roller being a backing cylinder. The first roller is brought in contact with the old web, and the backing roller then rotates through the cutting action to permit splicing to occur while maintaining a continuous supply of web material.

3 Claims, 1 Drawing Figure

APPARATUS FOR SPLICING A TRAILING END OF A WEB FROM A DEPLETED COIL TO THE LEADING END OF A FRESH COIL

FIELD OF THE INVENTION

This invention relates to an apparatus for joining without stopping the trailing end of a depleted coil of a paper web to the leading end of a fresh coil.

BACKGROUND OF THE INVENTION

Paper webs are generally wound in rolls or coils which can be of considerable size and are currently widely employed in many different fields and especially in the product packaging field. To provide a continuous supply of such a web to a packaging machine, apparatus is known which can carry simultaneously two paper coils; one serving to feed the web while the other is held in reserve. Such apparatus is equipped with a station in which the trailing edge of the coil being depleted is bonded to the leading edge of the reserve coil so the web can be supplied continuously to the packaging machine. Typically, in such prior art apparatus, to enable the trail edge or end of the coil being used to be connected to the leading edge or end of the fresh coil, it is necessary to stop the packaging machinery. This represents a functional drawback of considerable importance as well as a potential source of errors or failures seriously affecting the quality of the subsequent package.

PERTINENT ART

One pertinent art apparatus which does join in a continuous manner, the end of a web from a depleted coil to the leading edge of a fresh coil is U.S. Pat. No. 4,172,564. In this apparatus for joining while in a continuous movement, the trailing end of a web from a depleted coil to a leading end of a fresh coil, the patent discloses an apparatus having a bonding station, including a bonding cylindrical segment and a cylindrical service mating therewith and a lever and arm assembly actuated to cause cylindrical segments to be moved toward the mating surface in order to bond the tail end and the leading end edges to each other. Web cutting means described in the application includes a plate where the web is caused to rest and slide, which plate has a traverse slot adapted to allow a cutting blade to pass therethrough. Unfortunately the pneumatically fired knife does not move at the web speed which produces an undesirable amount of tension on the material to be unwound. The knife blades need to be of different designs for different materials to be cut.

Therefore, it is a primary object of this invention to provide an apparatus for carrying out during the continuous movement of the coils and packaging machine, the joining of an end of a depleted coil to an end of a fresh coil.

The further object of this invention is to provide such apparatus which is of simple construction so as to be integrated into an existing splicing system and which could be incorporated into any device that is running a web of material and needs the unit to cut off material at the web speed to achieve lap or butt splice.

A still further object of this invention is to enable the expiring web to be cut without a change in the web speed and the anvil roll to be driven by a knife roll to achieve the same surface cutting speed.

SUMMARY OF THE INVENTION

These and other objects are achieved by an apparatus for splicing a trailing end of a first web to an adherent leading edge of a second web and the trailing end of the second web to an adherent leading edge of a third web, comprising a rotatable first cutting cylinder including a first cutting means, a rotatable second cutting cylinder including a second cutting means, a rotatable anvil roll disposed between the first and the second cutting cylinders, the first cutting cylinder being rotatable between an extended position wherein the first cutting means is spaced apart from the anvil roll and a closed position wherein the first cutting means is rotated toward the anvil roll to rotationally engage a first web running therebetween and the first cutting means cuts the first web, the second cutting cylinder being rotatable between an extended position wherein the second cutting means is spaced apart from the anvil roll and a closed position wherein the second cutting means is rotated toward the anvil roll, and a pair of nip rollers downstream relative to web movement of the cutting cylinders and the anvil roll, the nip rollers being movable between an open position wherein the nip rollers are spaced apart and a closed position wherein the nip rollers rotationally engage and adhere the cut trailing end of the first web to an adherent leading edge of the second web.

BRIEF DESCRIPTION OF THE DRAWING

Further features will become apparent from the following detailed description of a preferred embodiment of the apparatus according to the invention, illustrated by way of example in the accompanying drawing wherein:

The FIGURE is a schematic side view of the inventive apparatus.

DETAILED DESCRIPTION OF THE INVENTION

Figure 1:
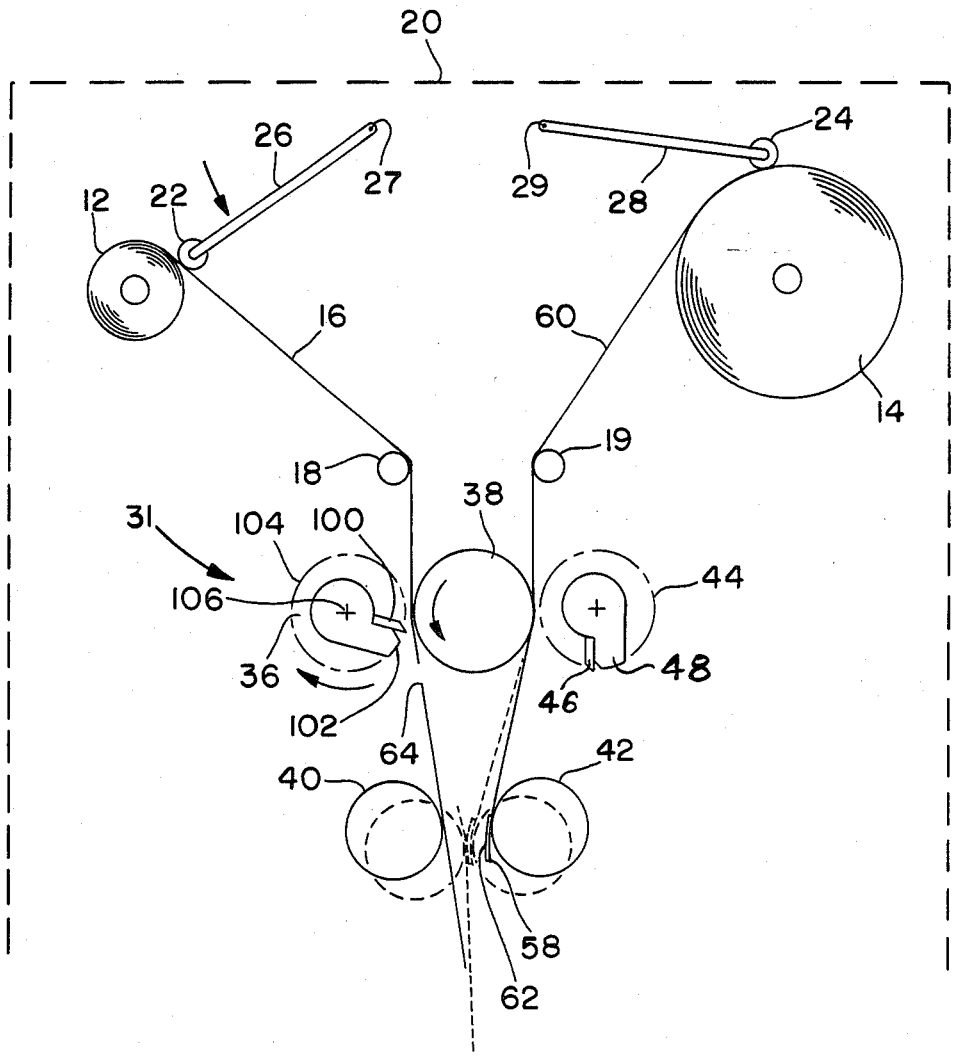

With reference to the FIGURE, the first coil 12 and a second coil 14 of web material are mounted along parallel axes, and may be mounted upon a supporting frame (not shown). The web material may, for example, be a web of paper. From coil 12, the web 16 is transferred over a roller 18 having its axis parallel and horizontal to the conveying machine, which is represented by block 20 in the dotted lines. The web 16 passes through the cut-off device of this invention generally designated as number 31. Similarly from coil 14, a similar web is fed to the cut-off device 31. In order to keep webs 16 and 60 in tension, rollers 22 and 24, respectively, bear upon the cylindrical surfaces of coils 12 and 14, respectively. The rollers 22 and 24 are mounted at the ends of respective arms 26 and 28. The other ends of arms 26 and 28, are journalled to the frame of the machine at points 27 and 29, respectively.

Below the two coils 12 and 14 is located the cut-off device 31 for cutting the web 16 of the expiring coil 12 for subsequent bonding to new web 60 of the fresh coil 14, yet to be unrolled. At this cut-off device 31, the web 16 is during operation guided and conveyed between respective first cutting cylinder 36 and anvil roller 38. From the cut-off device 31, the web 16 is conveyed through respective facing driven nip rollers 40 and 42. From the driven nip rollers, the spliced tape proceeds to the planned processing.

In detail, the cut-off device is made up of first cutting cylinder 36, anvil roller 38, and second cutting cylinder 44. Roller 38 acts as an anvil roll against which the cutting section of the first cutting cylinder 36 is brought into contact.

Cylinder 36 comprises a first cutting blade 100 mounted adjacent a tack material 102 on a circumference of the cylinder 36. The tack material does not cover the entire perimeter of cylinder 36, but the exposed edge of first cutting blade 100 and the tack material 102 have a greater diameter than the remaining perimeter 104 of cylinder 36. The cutting cylinder 36 is normally secured in a noncutting, nonrotating position in which the tack material 102 and the first cutting blade 100 are away from the web 16. When actuated, the cutting cylinder 36 is rotated about its axis 106 to a position such that the tack material 102 causes the web 16 to contact the roller 38. This contact moves the cutting blade 100 through its rotation causing the cutting of web 16. The cutting cylinder 36 is rotated for just one revolution and secured.

The apparatus just described operates as follows: after coils 12 and 14 have been installed, one of them, coil 12 in the FIGURE is unrolled and led through rollers/cylinders 18, 36, 38, 40 and 42 to the processing-/packaging machine not shown. Prior to coil 12 being exhausted, a new coil 14 is rotated to move its leading edge 58 of the new web 60 past the roller 19 and between anvil roller 38 and second cutting cylinder 44 to a position between the driven nip rollers 40 and 42. The leading edge 58 is provided with adhesive tape 62 having an outwardly facing adhesive layer. When the web of coil 12 is nearly exhausted, the position of arm 26 trips a switch which in turn actuates the cut-off device 31. First cutting cylinder 36 is rotated one revolution, cutting the web 16 to produce a trailing end 64 while the web is gripped between the roller 38 and the tack material 102 of cutting cylinder 36. Thereafter, nip rollers 40, 42 are moved together so as to engage and adhere the adhesive tape 62 of leading edge 58 of web 60 to trailing end 64 of web 16. This operation of nip rollers 40, 42 splices together the two webs 16, 60 without interrupting conveying machine 20, thereby supplying a continuous web of material. In a similar manner, when web 60 approaches its trailing end, it is cut by second cutting blade 46 and tack material 48 in conjunction with anvil roller 38. This trailing end of web 60 can then be similarly joined or spliced to a new supply of web 16.

In a preferred embodiment, a fourth roller (not shown) may be inserted between roller 38 and cylinder 44 to contact roller 38 on a continuous basis. Upon actuation of cylinder 36 near the end of the web 16, the same actuation may be applied to cylinder 44 without the exposed cutting blade. In doing so the web 60 is moved forward at a rate equivalent to that of the expiring web 16. At this time, after the tail end of coil 12 has been cut, the end 64 is advanced to between driven nip rolls 40 and 42 at the same time as the advancing leading edge 58 of web 60. Rolls 40 and 42 contact end 64 with the adhesive portion 62 on web leading edge 58. This lessens the inertia of the new coil and web and reduces the chances of breaking the web. The result obtained is without interrupting the web unrolling or feeding at any point. The invention described herein above is susceptible to many modifications and variations, all of which fall within the scope of the instant inventive concept.

I claim:

1. An apparatus for splicing a trailing end of a first web to an adherent leading edge of a second web and a trailing end of the second web to an adherent leading edge of a third web, comprising:

a rotatable first cutting cylinder including a first cutting means, a rotatable second cutting cylinder including a second cutting means, a rotatable anvil roll disposed between said first and said second cutting cylinders, said first cutting cylinder being rotatable between an extended position wherein said first cutting means is spaced apart from said anvil roll and a closed position wherein said first cutting means is rotated toward said anvil roll to rotationally engage a first web running therebetween and said first cutting means cuts the first web, said second cutting cylinder being rotatable between an extended position wherein said second cutting means is spaced apart from said anvil roll and a closed position wherein said second cutting means is rotated toward said anvil roll, and a pair of nip rollers downstream, relative to web movement, of said cutting cylinders and said anvil roll, said nip rollers being movable between an open position wherein said nip rollers are spaced apart and a closed position wherein said nip rollers rotationally engage and adhere the cut trailing end of the first web to an adherent leading edge of a second web.

2. The apparatus of claim 1 wherein said second cutting cylinder when rotated to said closed position rotationally engages the second web and said second cutting means cuts the second web, and wherein said nip rollers when moved to their closed position rotationally engage and adhere the cut trailing edge of the second web to an adherent leading edge of a third web running between said nip rollers.

3. The apparatus of claim 2 further comprising a first tack member on said rotatable first cutting cylinder, and a second tack member on said rotatable second cutting cylinder, each said tack member being rotationally engageable with its respective web against said rotatable anvil roll when at said closed position, thereby assisting a respective said cutting means in cutting a web.

* * * * *